US005632609A

United States Patent [19]

Hashimoto

[11] Patent Number: 5,632,609

[45] Date of Patent: May 27, 1997

[54] VALVED DISCHARGE MECHANISM OF A REFRIGERANT COMPRESSOR

[75] Inventor: Kenji Hashimoto, Yamada-gun, Japan

[73] Assignee: Sanden Corporation, Gunma, Japan

[21] Appl. No.: 514,815

[22] Filed: Aug. 14, 1995

[30] Foreign Application Priority Data

Aug. 15, 1994 [JP] Japan ..... 6-191523

[51] Int. Cl.[6] ..... F04B 53/10

[52] U.S. Cl. ..... 417/571; 137/856

[58] Field of Search ..... 417/569, 571; 137/855, 856

[56] References Cited

U.S. PATENT DOCUMENTS

| | | | |
|---|---|---|---|
| 3,949,716 | 4/1976 | Liu | 137/856 |
| 4,076,047 | 2/1978 | Akahori | 137/856 |
| 4,730,550 | 3/1988 | Bramstedt et al. | 137/855 |

FOREIGN PATENT DOCUMENTS

| | | | |
|---|---|---|---|
| 699434 | 2/1931 | France | 137/856 |

*Primary Examiner*—Charles G. Freay
*Attorney, Agent, or Firm*—Baker & Botts, L.L.P.

[57] ABSTRACT

A refrigerant compressor comprises a compressor housing divided at least partially by a valve plate into a first chamber and a second chamber, the second chamber comprises a discharge chamber. An elastic valve member is capable of bending to open and close an end opening of the conduit. The valve member has a predetermined elastic modulus and is arranged such that the end opening of the conduit remains blocked until a pressure in the first chamber reaches a predetermined value. The valve plate includes a valve seat surrounding the end opening of the conduit and a recessed portion offset from the end surface of the valve plate. The recessed portion includes an inclined surface portion and a wall portion extending therefrom so that the elastic valve member closes the end opening of the conduit without striking the end surface of the valve plate due to an elastic restoring force of the elastic valve member. Noise and vibration caused by the striking of discharge reed valve against the valve plate are thus decreased. As a result, noise and vibration propogated to the passenger compartment of a vehicle are decreased.

6 Claims, 4 Drawing Sheets

VALVED DISCHARGE MECHANISM OF A REFRIGERANT COMPRESSOR

BACKGROUND OF THE INVENTION

1. Field of the Invention

The present invention relates to a refrigerant compressor and, more particularly, to a valved discharge mechanism of a refrigerant compressor used in an automotive air conditioning system.

2. Description of the Prior Art

Valved discharged mechanisms of refrigerant compressors are well known in the prior art. For example, FIG. 7 depicts a valved discharge mechanism used in the refrigerant compressor described in U.S. Pat. No. 4,978,285. As disclosed therein, a refrigerant compressor includes a compressor housing defining a compression chamber in which successive strokes of intake, compressing, and discharge of a refrigerant gas are repeatedly performed. Further, the compressor includes valve plate 65 which is formed to partition the compression chamber from a discharge chamber and a discharge valve assembly mounted on an end surface of valve plate 65. Valve plate 65 has discharge hole 652 extending therethrough and allowing communication of the compression chamber with the discharge chamber. The discharge valve assembly includes discharge reed valve 81 and valve retainer 80 which are secured together to outer surface 65*a* of valve plate 65 by fixing bolt 82. Discharge reed valve 81, which is made of elastic material, regulates the flow of the refrigerant gas and makes sealing contact against end surface 65*a* of valve plate 65 without air gap when the operation of compressor is stopped.

Valve retainer 80 limits the bending movement of discharge reed valve 81 in the direction in which the refrigerant gas leaves the compression chamber and enters the discharge chamber through discharge hole 652. Discharge reed valve 81 bends to close and open one end opening of discharge hole 652, and has a predetermined value of elastic modulus which allows discharge reed valve 81 to keep one end opening of discharge hole 652 closed, until a pressure in the compression chamber reaches a predetermined value.

In such arrangement, discharge reed valve 81 strikes retainer 80 when it opens. On the other hand, discharge reed valve 81 strikes end surface 65*a* of valve plate 65 when it closes. Thus, a compressor with such a discharge valve arrangement disadvantageously generates vibration and noise during operation due to this striking. Particularly, vibration and noise caused by reed valve 81 striking end surface 65*a* of valve plate 65 is disadvantageous. After refrigerant is discharged, reed discharge valve 81 returns to its closed position due to elastic restoring force. The magnitude of the elastic restoring force is sufficiently large to cause discharge reed valve 81 to bend past the plane of end surface 65*a* before returning to its closed position (for instance, valve 81, if unobstructed, may return to its closed position through a damped periodic motion). End surface 65*a*, however, presents an obstacle to discharge reed valve 81. Therefore, the elastic restoring force causes reed valve 81 to strike end surface 65*a* of plate 65 and thereby generate a large amount of noise and vibration. This offensive noise and vibration propagates to the passenger compartment of the vehicle.

SUMMARY OF THE INVENTION

It is an object of the present invention to provide a refrigerant compressor for use in an automotive air conditioning system having a valved discharge mechanism which can effectively reduce vibration and noise caused by the discharge valve assembly and thus, reduce the propagation of offensive noise and vibration to the passenger compartment of a vehicle.

It is a further object of the present invention to provide a refrigerant compressor wherein volumetric efficiency of the compressor is improved.

According to the present invention, a refrigerant compressor comprises a compressor housing divided at least partially by a valve plate into a first chamber and a second chamber, the second chamber comprises a discharge chamber. A linking member links the first chamber to the discharge chamber and includes a conduit providing communication between the first chamber and the discharge chamber. The conduit has an end opening through which a refrigerant gas may exit therefrom. An elastic valve member is capable of bending to open and close the end opening of the conduit. The valve member has a predetermined spring constant, and is positioned such that the end opening of the conduit remains blocked until a pressure in the first chamber reaches a predetermined value. A limiting member limits the bending movement of the valve member in a direction in which the refrigerant gas exits the end opening of the conduit. A valve seat is formed in an end surface of the valve plate and surrounds the end opening of the conduit, said valve seat including a recessed portion offset from the end surface of the plate. The recessed portion includes an inclined surface portion and a wall portion extending from the inclined surface portion so that the elastic valve member closes the end opening of the conduit without striking the end surface of the valve plate due to the elastic restoring force of the valve member thereby lessening noise and vibration.

Further objects, features and other aspects of the present invention will be understood from the detailed description of the preferred embodiment of the present invention with reference to the annexed drawings.

DETAILED DESCRIPTION OF THE DRAWINGS

Figure 1:
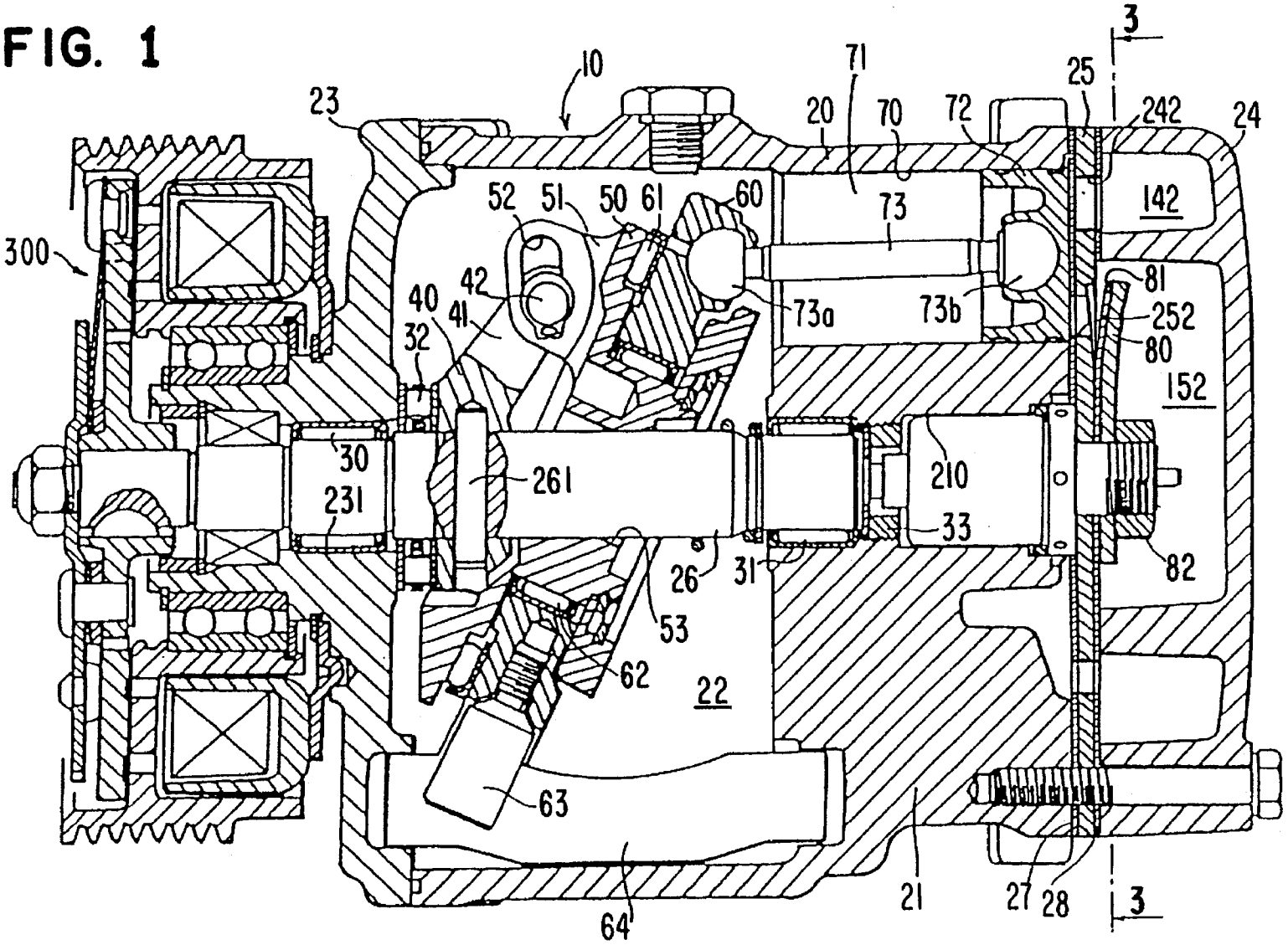
FIG. 1 is a longitudinal sectional view of a slant plate type refrigerant compressor in accordance with the present invention.

FIG. 1 illustrates a fluid displacement apparatus in accordance with the present invention, in particular a slant plate type compressor, according to one embodiment of the present invention. A compressor comprises cylindrical housing assembly 20 including cylinder block 21, crank chamber 22, front end plate 23, rear end plate 24, and valve plate 25. Crank chamber 22 is formed between cylinder block 21 and front end plate 23.

Front end plate 23 is mounted on one end of cylinder block 21 (to the left side in FIG. 1) by a plurality of bolts (not shown). Rear end plate 24 is mounted on the opposite end of cylinder block 21 by a plurality of bolts (not shown). Valve plate 25 is located between rear end plate 24 and cylinder block 21. Opening 231 is centrally formed in front end plate 23 and supports drive shaft 26 by bearing 30 disposed in the opening. The inner end portion of drive shaft 26 is rotatably supported by bearing 31 disposed within center bore 210 of cylinder block 21. Bore 210 extends to a rearward end surface of cylinder block 21 wherein there is disposed valved control mechanism.

Cam rotor 40 is fixed on drive shaft 26 by pin member 261 and rotates with shaft 26. Thrust needle bearing 32 is disposed between the inner end surface of front end plate 23 and the adjacent axial end surface of cam rotor 40. Cam rotor 40 includes arm 41 having pin member 42 extending therefrom. Slant plate 50 is adjacent cam rotor 40 and includes opening 53 through which passes drive shaft 26. Slant plate 50 includes arm 51 having slot 52. Cam rotor 40 and slant plate 50 are connected by pin member 42, which is inserted in slot 52 to create a hinged joint. Pin member 42 is slidable within slot 52 to allow adjustment of the angular position of slant plate 50 with respect to the longitudinal axis of drive shaft 26.

Wobble plate 60 is nutatably mounted on slant plate 50 through bearings 61 and 62. Fork-shaped slider 63 is attached to the outer peripheral end of wobble plate 60 and is slidably mounted about sliding rail 64 held between front end plate 23 and cylinder block 21. Fork-shaped slider 63 prevents rotation of wobble plate 60, and wobble plate 60 nutates along rail 64 when cam rotor 40 rotates. Cylinder block 21 includes a plurality of peripherally located cylinder chambers 70 in which pistons 72 reciprocate. Each piston 72 is connected to wobble plate 60 by a corresponding connecting rod 73. Each piston 72 and connecting rod 73 substantially compose piston assembly 71 as discussed below.

Rear end plate 24 includes peripherally located annular suction chamber 142 and centrally located discharge chamber 152. Valve plate 25 is located between cylinder block 21 and rear end plate 24 and includes a plurality of valved suction holes 242 linking each suction chamber 142 with respective cylinder 70. Valve plate 25 also includes a plurality of valved discharge holes 252 linking discharge chamber 152 with cylinder chambers 70.

Each suction chamber 142 includes an inlet port which is connected to an evaporator of the external cooling circuit (not shown). Discharge chamber 152 is provided with outlet portion connected to a condenser of the cooling circuit (not shown). Gaskets 27 and 28 are located between cylinder block 21 and the inner surface of valve plate 25, and the outer surface of valve plate 25 and rear end plate 24, respectively, to seal the mating surfaces of cylinder block 21, valve plate 25 and rear end plate 24.

Disk-shaped adjusting screw member 33 is disposed in a central region of bore 210 located between the inner end portion of drive shaft 26 and valve control mechanism. Disk-shaped adjusting screw member 33 is screwed into bore 210 to be in contact with the inner end surface of drive shaft 26 through a washer, and adjusts an axial position of drive shaft 26 by tightening and loosening thereof. Piston assembly 71 includes connecting rod 73 which includes a pair of ball portions **73*a* and 73*b* formed at both ends thereof and cylindrically-shaped piston 72 which is connected to ball portion 73*b* formed at the rear end of connecting rod 73**.

Figure 2:
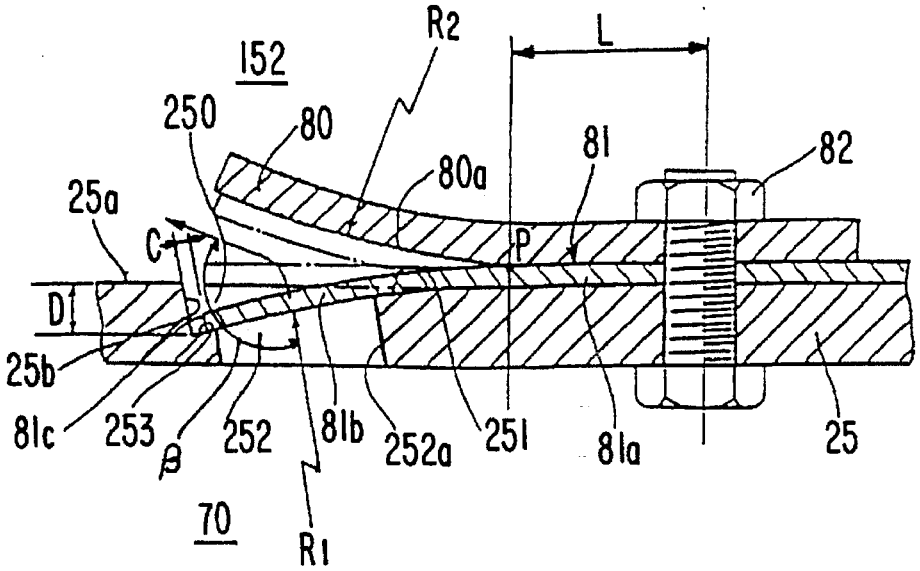
FIG. 2 is an enlarged sectional view of a discharge valve assembly in accordance with a first embodiment of the present invention.
Figure 3:
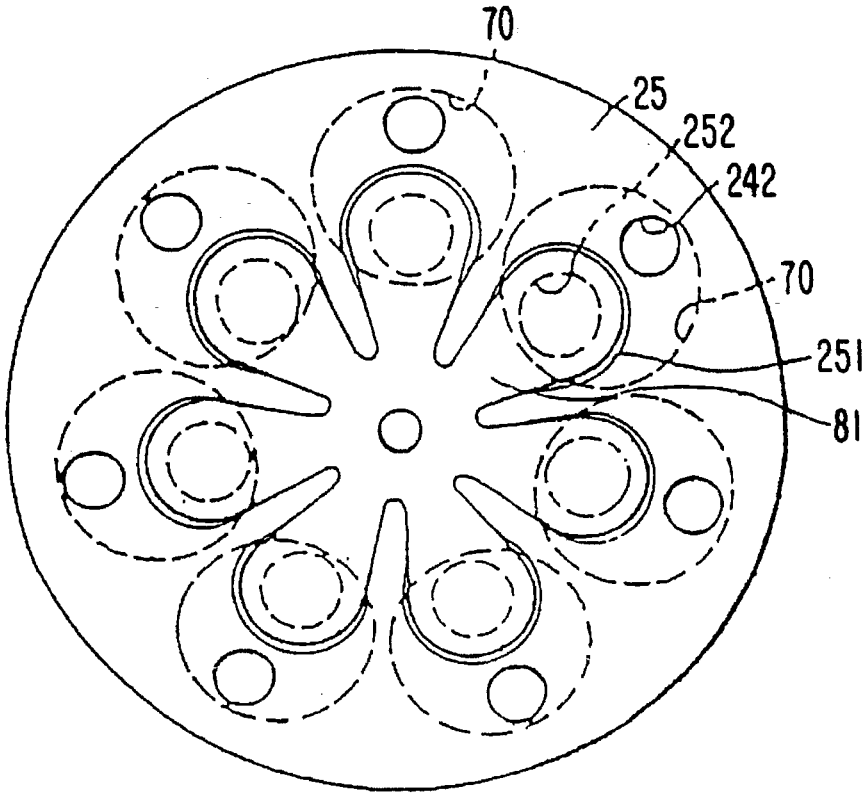
FIG. 3 is a cross sectional view of the discharge valve assembly taken along line 3—3 of FIG. 1.

Referring to FIGS. 2 and 3, the discharge valve assembly includes discharge reed valve 81 and valve retainer 80 which are secured together to valve plate 25 by fixing bolt 82. Discharge reed valve 81, which is made of an elastic member e.g., thin spring steel, regulates a flow of the refrigerant gas and is divided into basic portion **81*a* formed at side of fixing bolt 82, and sealing portion 81*b* extending from basic portion 81*a*. Valve plate 25 includes recessed portion 250 formed so that its depth increases with distance from point P which is spaced a distance L from fixing bolt 82. Recessed portion 250 includes inclined surface 251 which is in sealing contact with discharge reed valve 81 when discharge reed valve 81 is in its closed position. Inclined surface 251 has a curved cross-section having a radius of curvature R1 which defines the closing deformation of discharge reed valve 81. Recessed portion has a depth D, defined between end surface 25*a* of valve plate 25 and front end 253 of inclined surface 251. Further, valve plate 25 includes discharge hole 252 extending therethrough and including inner wall 252*a* arranged to be parallel to a radial line of inclined surface 251, drawn through the center of opening 252. Recessed portion 250 and portions therein, i.e., inclined surface 251, end surface 25*a*, and front end 253** collectively comprise a valve seat.

Valve retainer 80 limits the bending movement of discharge reed valve 81 in the direction which the refrigerant gas exits discharge hole 252. Discharge reed valve 81 bends as it opens and closes discharge hole 252, and has a spring constant which allows discharge reed valve 81 to block discharge hole 252 until a pressure in compression chamber 70 reaches a predetermined value. Retainer 80 includes curved surface **80*a* having radius of curvature R2 in cross-section which defines the opening deformation of discharge reed valve 81. Radius of curvature R1 is preferably designed to be equal to or less than radius of curvature R2 so that when reed valve 81 closes, its elastic restoring force will not cause it to strike end surface 25*a* of valve plate 25**.

Moreover, recessed portion 250 includes end wall **25*b* extending from inclined surface 251 and parallel to inner wall 252*a* of discharge hole 252 so as to surround outside edge 81*c* of discharge reed valve 81. A gap between end wall 25*b* and edge 81*c* of discharge reed valve 81** is defined by C. Preferably, gap C is designed to be from about 0.5 to 1.5 mm.

In this arrangement, drive shaft 26 is rotated by the engine of the vehicle through electromagnetic clutch 300. Cam rotor 40 rotates with drive shaft 26, thereby rotating slant plate 50 and causing wobble plate 60 to nutate. Nutational motion of wobble plate 60 reciprocates pistons 71 in their respective cylinder 70. As pistons 71 are reciprocated, refrigerant gas, introduced into suction chamber 142 through inlet portion ports (not shown), is drawn into cylinders 70 and compressed. The compressed refrigerant gas is discharged to discharge chamber 152 from each cylinder 70 through discharge holes 252, and therefrom into the cooling circuit through outlet portion (not shown).

Further, an impact force with which discharge reed valve 81 strikes inclined surface 251 of valve plate 25 is smaller than that with which discharge reed valve 81 strikes retainer 80. This occurs because in the arrangement of FIG. 2, discharge reed valve 81 returns to its closed position because of the pressure difference between cylinders 70 and discharge chamber 152 impressing discharge reed valve 81 rather than because of the elastic restoring force of discharge reed valve 81. Therefore, noise and vibration caused by discharge reed valve 81 striking valve retainer 80 and end surface 25*a* of valve plate 25 are decreased.

Further, the discharge refrigerant gas, which flows from cylinder 70 to discharge chamber 152, has a gentle angle of incidence, β, of refrigerant gas flow along the discharge valve, in comparison with the angle of incidence of the prior art. The angle of incidence, β, is shown in FIGS. 2 and 4–6. Thereby, pressure loss and pulsation of discharge gases are decreased since the refrigerant gas is subjected to a fluid friction from discharge reed valve 81. As a result, the noise and vibration of the compressor are also decreased.

Figure 7:
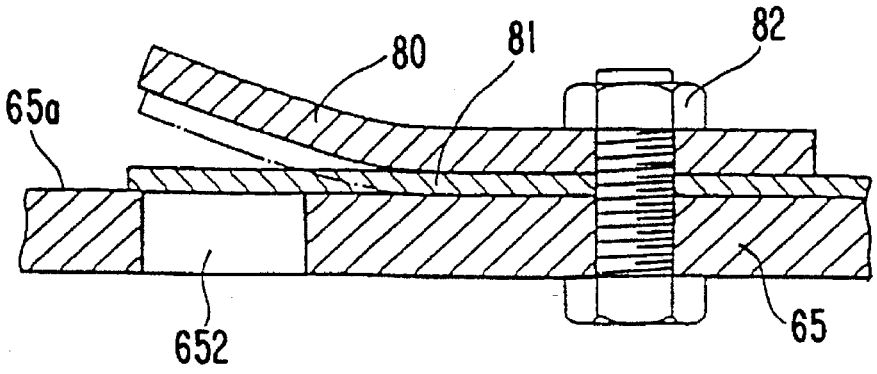
FIG. 7 PRIOR ART
FIG. 7 is an enlarged sectional view of a discharge valve assembly in accordance with the prior art.

Additionally, the volume of discharge holes 252 is smaller than the volume of discharge holes 652 of the prior art, shown in FIG. 7. Although valve plate 25 and prior art valve plate 65 have a common thickness, valve plate 25 has recessed portion 250 which decreases the volume of the discharge hole 252. Volumetric efficiency is generally defined by the ratio of the theoretical piston displacement volume to practical piston displacement volume. Therefore, the volumetric efficiency of a compressor with a discharge valve arrangement as shown in FIG. 2 increases because the clearance pocket volume of the cylinders which is created by the inner capacity of discharge holes is decreased.

Moreover, gap C is designed to be small, e.g., about 0.5 to 1.5 mm, so that gap C does not influence the movement of discharge reed valve 81. That is, discharge reed valve 81 is quickly attracted to inclined surface 251 at the beginning stage of compressor operation allowing the compressor to have a fast starting response.

Figure 4:
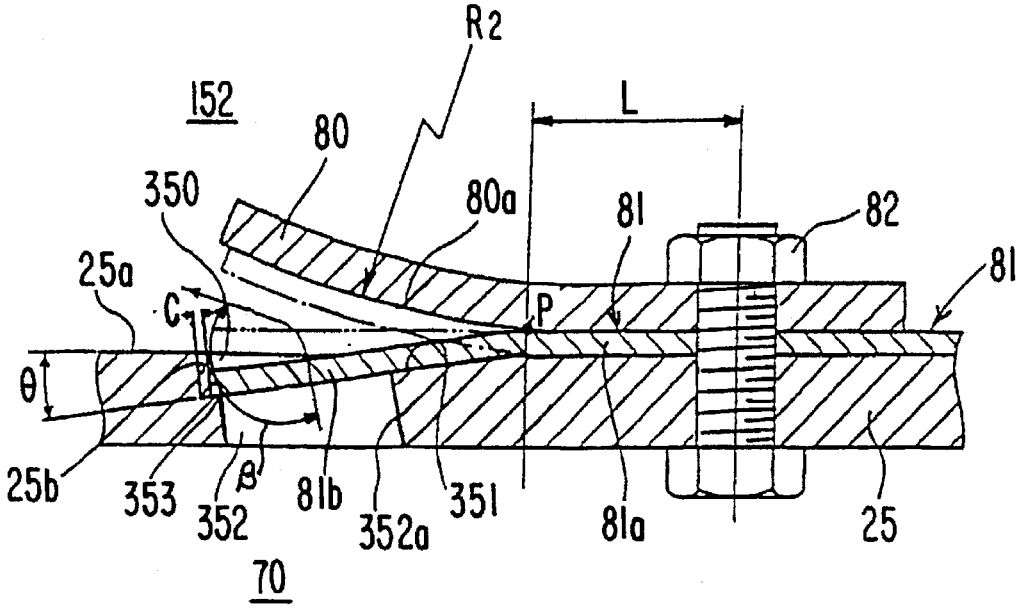
FIG. 4 is an enlarged sectional view of a discharge valve assembly in accordance with a second embodiment of the present invention.

FIG. 4 illustrates a second embodiment of the present invention. The embodiment of FIG. 4 is similar to FIG. 2. Valve plate 25 includes recessed portion 350 formed so that its depth increases with distance from point P which is spaced a distance L from fixing bolt 82. Recessed portion 350 includes inclined surface 351 which is in sealing contact with discharge reed valve 81 when discharge reed valve 81 is in the closed position. In this embodiment, inclined surface 351 has a sloped linear cross-section which defines the closing deformation of discharge reed valve 81. The slope angle of sealing portion 81*b* in relation to basic portion 81*a* is defined by θ. Angle θ is designed so that discharge reed valve 81 is in sealing contact with inclined surface 351.

The structure of FIG. 4 has substantially the same advantages as those of the first embodiment. Moreover, in this embodiment, discharge hole 452 is easily machined in comparison with curved surface 251 of valve plate 25.

Figure 5:
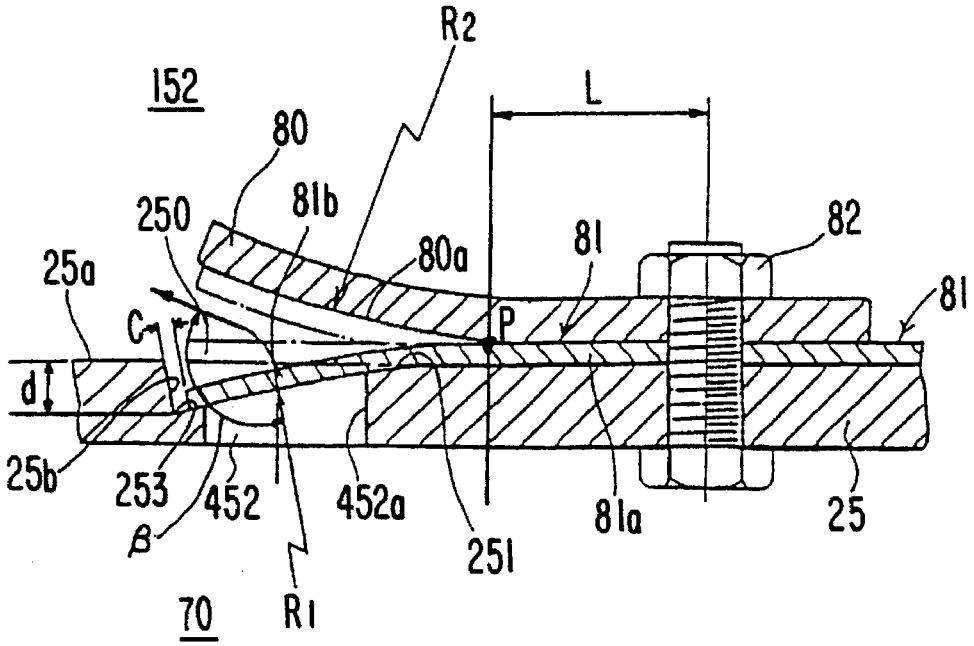
FIG. 5 is an enlarged sectional view of a discharge valve assembly in accordance with a third embodiment of the present invention.

FIG. 5 illustrates a third embodiment of the present invention. The embodiment of FIG. 5 is similar to the embodiment of FIG. 2. Valve plate 25 includes discharge hole 452 therethrough. Discharge hole 452 includes inner wall 452*a* which is perpendicular to end surface 25*a* of valve plate 25.

The structure of FIG. 5 has substantially the same advantages as those of the first embodiment. Moreover, in this embodiment, discharge hole 452 is easily machined in comparison with discharge hole 252 of FIG. 2.

Figure 6:
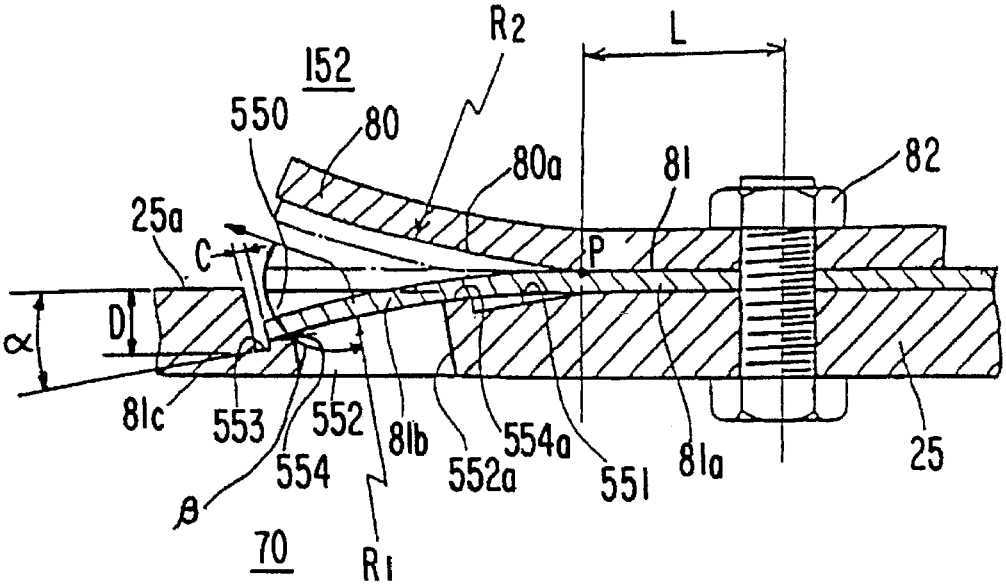
FIG. 6 is an enlarged sectional view of a discharge valve assembly in accordance with a fourth embodiment of the present invention.

FIG. 6 illustrates a fourth embodiment of the present invention. The embodiment of FIG. 6 is similar to the embodiment of FIG. 2. Recessed portion 550 includes inclined surface 551 having a sloped linear cross-section, and projection portion 554 extending from inclined surface 551. Projection portion 554 is in sealing contact with discharge reed valve 81, when reed valve 81 is in the closed position. That is, surface portion 554*a* of projection portion 554 is annular shaped and has a curved cross-section with radius of curvature R1 which defines the closing deformation of discharge reed valve 81. The slope angle of sealing portion 81*b* in relation to basic portion 81*a* is defined by α. Angle α is designed so that discharge reed valve 81 is in sealing contact with surface portion 554*a* of projection portion 554.

The structure of FIG. 6 has substantially the same advantages as those of the first embodiment. Moreover, in the embodiment of FIG. 6, the sealing contact between surface portion 554*a* of projection portion 554 and discharge reed valve 81 is closer than the sealing contact between inclined surface 251 and discharge reed valve 81 of FIG. 2. This occurs because lubricating oil compound in the refrigerant gas remaining on surface portion 554*a* is drained off toward inclined surface 551.

Although the present invention has been described in connection with the preferred embodiment, the invention is not limited thereto. It will be easily understood by those of ordinary skill in the art that variations and modifications can be easily made within the scope of this invention as defined by the appended claims.

I claim:

1. A refrigerant compressor comprising:

a compressor housing divided at least partially by a valve plate into a first chamber and a second chamber, said second chamber comprising a discharge chamber;

a linking means for linking said first chamber to said discharge chamber, said linking means including a conduit providing communication between said first chamber and said discharge chamber, said conduit having an end opening through which a refrigerant gas exits therefrom;

an elastic valve member capable of bending to open and close said end opening of said conduit, said valve member having a predetermined spring constant and positioned, such that said end opening of said conduit remains blocked until a pressure in said first chamber reaches a predetermined value;

a limiting member for limiting bending movement of said valve member in a direction in which said refrigerant gas exits said end opening of said conduit, said limiting member including a retainer member;

a valve seat formed in an end surface of said valve plate and surrounding said end opening of said conduit, said valve seat including a recessed portion offset from the end surface of said valve plate, said recessed portion including an inclined surface portion and a wall portion extending from the inclined surface portion so that said elastic valve member closes said end opening of said conduit without striking the end surface of the valve plate due to an elastic restoring force of the elastic valve member;

wherein said inclined surface portion has a curved cross-section having a radius of curvature, said elastic valve member being in sealing contact with said surface portion when it closes said end opening of said conduit; and wherein said curved cross-section of said inclined surface portion has a radius of curvature equal to or less than a radius of curvature or said retainer member.

2. The refrigerant compressor of claim 1, wherein said inclined surface portion is formed at a depth below said one end surface of said valve plate, said depth decreasing with distance from an outside edge of the elastic valve member.

3. The refrigerant compressor of claim 1, wherein said conduit includes an inner wall arranged to be parallel to a radial line of the inclined surface through the center of the end opening of said conduit.

4. The refrigerant compressor of claim 1, wherein said conduit includes an inner wall arranged to be perpendicular to the end surface of the valve plate.

5. The refrigerant compressor of claim 1, wherein said recessed portion further comprises an annular projection portion extending from said inclined surface, said elastic valve member in sealing contact with said annular projection portion when it closes said end opening of said conduit.

6. The refrigerant compressor of claim 1, further comprising a gap between said wall portion of said recessed portion and an outside edge of said elastic valve member.

* * * * *